US010759501B2

(12) United States Patent
Askestad

(10) Patent No.: US 10,759,501 B2
(45) Date of Patent: Sep. 1, 2020

(54) EXCHANGEABLE RAIL SYSTEM FOR LARGE TURRET BEARING

(71) Applicant: APL TECHNOLOGY AS, Kolbjørnsvik (NO)

(72) Inventor: Sigmund Askestad, Tvedestrand (NO)

(73) Assignee: APL TECHNOLOGY AS, Kolbjørnsvik (NO)

( * ) Notice: Subject to any disclaimer, the term of this patent is extended or adjusted under 35 U.S.C. 154(b) by 0 days.

(21) Appl. No.: 16/461,708

(22) PCT Filed: Nov. 17, 2017

(86) PCT No.: PCT/NO2017/000030
§ 371 (c)(1),
(2) Date: May 16, 2019

(87) PCT Pub. No.: WO2018/093269
PCT Pub. Date: May 24, 2018

(65) Prior Publication Data

US 2019/0359292 A1 Nov. 28, 2019

(30) Foreign Application Priority Data

Nov. 17, 2016 (NO) ..... 20161814

(51) Int. Cl.
*B63B 71/00* (2020.01)
*B63B 21/50* (2006.01)
*B63B 3/14* (2006.01)

(52) U.S. Cl.
CPC ..... *B63B 21/507* (2013.01); *B63B 3/14* (2013.01); *B63B 71/00* (2020.01); *B63B 2003/147* (2013.01)

(58) Field of Classification Search
CPC ..... B63B 21/507; B63B 71/00; B63B 3/14; B63B 2003/147
See application file for complete search history.

(56) References Cited

U.S. PATENT DOCUMENTS 6,474,252 B1 11/2002 Delago
2003/0154899 A1* 8/2003 Cottrell ..... B63B 21/507 114/230.12

FOREIGN PATENT DOCUMENTS

EP 2 145 819 A1 1/2010
EP 2 634 078 A2 9/2013
(Continued)

OTHER PUBLICATIONS

International Search Report, issued in PCT/NO2017/000030, dated Feb. 15, 2018.
(Continued)

*Primary Examiner* — Stephen P Avila
(74) *Attorney, Agent, or Firm* — Birch, Stewart, Kolasch & Birch, LLP

(57) ABSTRACT

A rail system for large turret bearing includes a turret bearing support structure, a rail support ring provided with a L-shaped cross section including an inward directed wedge mating face, at least two rings of radially elongated segment bolt holes, and an outermost ring of wedge bolt holes, a plurality of rail segments together forming a complete circle with an outer radius slightly smaller than the radius of the wedge mating face of the rail support ring. Each segment includes a sloped outer wedge mating surface, a downward facing contact surface with threaded bolt holes corresponding to the bolt holes in the rail support ring, an upper largely horizontal surface, and an inner largely vertical surface.

20 Claims, 9 Drawing Sheets

(56) References Cited

FOREIGN PATENT DOCUMENTS

| | | | |
|---|---|---|---|
| KR | 10-2015-0095361 | A | 8/2015 |
| WO | WO 97/48595 | A1 | 12/1997 |
| WO | WO 2011/115505 | A2 | 9/2011 |
| WO | WO 2015/123567 | A1 | 8/2015 |

OTHER PUBLICATIONS

Written Opinion of the International Searching Authority, issued in PCT/NO2017/000030, dated Feb. 15, 2018.

* cited by examiner

EXCHANGEABLE RAIL SYSTEM FOR LARGE TURRET BEARING

TECHNICAL FIELD

This invention relates to offshore installations in particular to a rail system for a large turret wheel bearing usually found at the surface termination of a riser on a turret mooring related to extraction of hydrocarbons.

BACKGROUND

Turret mooring systems have been in use for some decades and as the search for hydrocarbons has increased, the depth from which hydrocarbons can be extracted has increased. The risers coming from greater depths are associated with greater loads and the turret wheel bearings now has to handle hundreds of tons. If the turret wheel bearing fails production must stop. Because of this it is desirable to maintain the turret wheel bearing while operating or minimize the length of the stoppage. Previous state of the art pretension systems comprise clamps or/and bolts pressing the rail segments against the support structure much like in rail way technology. The contact face between the adjacent rail segments will then be without compression stresses. Welded joints limit the selection of high strength materials which are required for these high loads.

The objective with using a rail comprised of rail segments is to apply materials with very high strength uneasy to weld
limit the size of individual components
replace segments with the turret in place A very important feature is that the rail is getting a substantial compression stress by the pretension system. Advantages are:

1. contact between the rail segments remains in compression even at extreme radial turret loads
2. rail segments remain in stable position relative one to another thus avoiding fretting fatigue in the mating surfaces between adjacent rail segments
3. a high compression stress in the rail is advantages for the stress level in the contact zone between the wheel and the rail by the hydrostatic pressure effects
4. a rail subject to compression has a higher fatigue strength than without compression stresses.
5. the strength of the rail remains intact also in the rail joints 21.

Re. 1. The compression in the rail is larger than the tangential stresses generated by the radial turret loads.

Re. 2. The rail segments in the rail joints remain in relative vertical position due to the tongue and groove and due to the substantial clamping effects from the rail bolts 24.

Re. 5. The strength of the rail in the edge of the material will be reduced. Generally, the contact pressure at the edge of a raceway for a roller bearing should generally be avoided or substantially reduced compared with pressure in the contact zone in the middle of the material. This is due to the hydrostatic effects obtained in the middle of the material, while at the edge there will be a tendency for the material to break away by the shear effect. By a substantial compression of the adjacent rail segments, it is obtained a rail joint where the neighboring rail segment are supporting each other. End face of the rail segment 42 is mutually supporting each other so that the combined effect will be close to the situation of an endless rail.

KR 2015/0095361 A discloses a turret bearing supporting a turret in pool of a hull. The turret bearing comprises: a supporter mounted on the pool; a control bar installed in the supporter; a support plate moveably mounted to move from the supporter to the turret; and height adjustment means to move the support plate by means of the control bar.

WO 2015/123567 A1 describes a bearing assembly including a support ring, a plurality of bearing-element carrier members coupled to the support ring, and a plurality of superhard bearing elements having a lateral periphery extending between a base and a superhard bearing surface. At least one superhard bearing element of the plurality of superhard bearing elements is attached to each of the plurality of bearing-element carrier members. A bearing apparatus includes a rotor, a stator, and a bearing assembly. A method for assembling a bearing assembly includes attaching at least one superhard bearing element to each of a plurality of bearing-element carrier members and coupling the plurality of bearing-element carrier members to a support ring.

A rail system according to claim 1 and methods for mounting and replacing according to claims 10 and 11 helps to obtain the objectives and advantages mentioned above.

SUMMARY OF THE INVENTION

The invention relates to a rail system for large turret bearings comprising a turret bearing support structure, a rail support ring with a L-shaped cross section comprising an inward directed wedge mating face, at least two rings of radially elongated segment bolt holes, and an outermost ring of wedge bolt holes, a plurality of rail segments together forming a complete circle with an outer radius slightly smaller than the radius of the wedge mating face of the rail support ring. Each segment comprises a sloped outer wedge mating surface, a downward facing contact surface with threaded bolt holes corresponding to the bolt holes in the rail support ring, an upper largely horizontal surface, and an inner largely vertical surface. Furthermore the rail system comprise trapeze shaped wedges each with at least one bolt hole and corresponding bolt(s), adapted to be tightened down between the wedge mating face of the support ring and the sloped outer wedge mating surface of the segments, and rail bolts for fastening the rail segments.

Furthermore the invention comprises a method for mounting the rail system and a method for replacing a rail segment.

BRIEF DESCRIPTION OF THE FIGURES

For better understanding of the invention the device will be described with reference to the figures. Like numerals describe like parts in the different figures.

DETAILED DESCRIPTION

Figure 1:
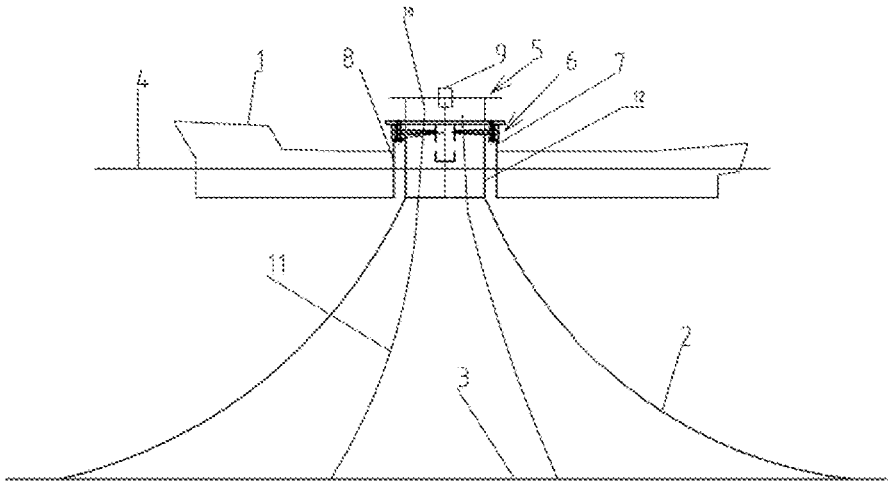
FIG. 1 shows a turret mounted on a ship.

FIG. 1 is showing a turret 5 in a moored vessel 1. The turret 5 is geostationary relative to the sea floor 3. Mooring lines 2 keeps the vessel in position and risers 11 connects the flowlines (not shown) on the sea floor with the vessel through a riser termination piping 10 in the turret through a rotary pipe connection (swivel) 9. The turret bearing 6 features an endless low-torque rotation of the vessel relative to the turret.

Figure 2:
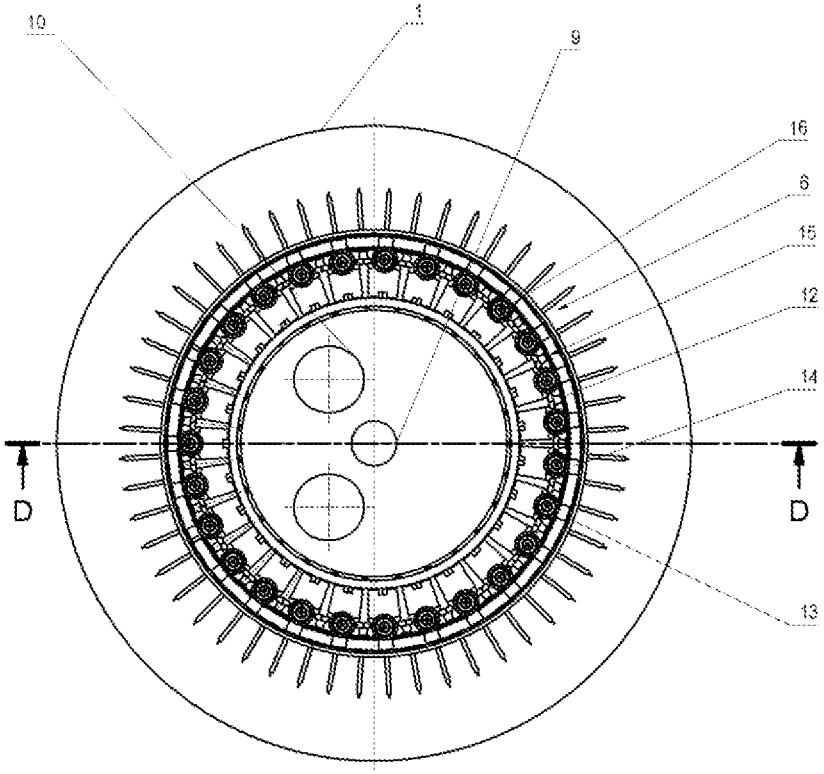
FIG. 2 shows a top view of a cross section of the turret wheel bearing with both horizontal and vertical wheels.
Figure 3:
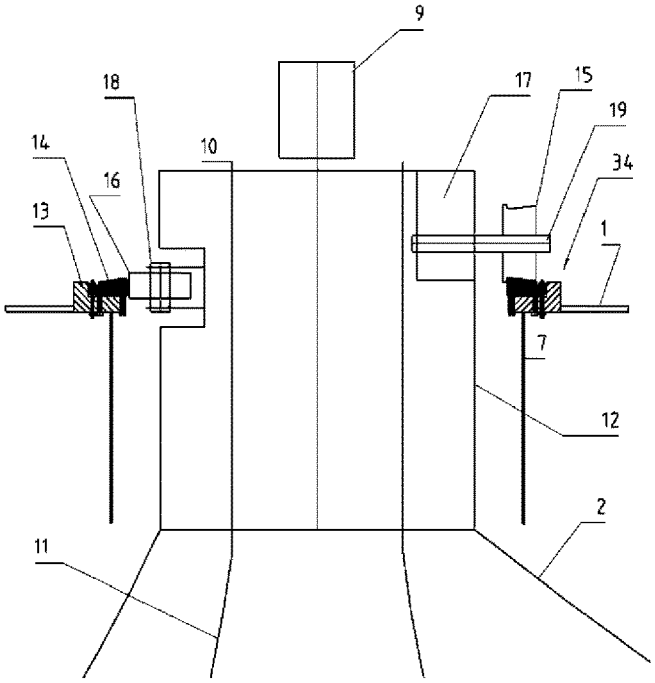
FIG. 3 shows a cross section of a turret bearing along the line D-D in FIG. 2.

FIG. 2 is showing a top view of the turret with bearing 6 and FIG. 3 is showing a section of the turret complying with the section line D-D in FIG. 2 featuring the rail system 34 with rail segments 20 wedges 43 with bolts 44, rail bolts 24 and retainers 27. In this embodiment the turret bearing includes an equal number of axial wheels 15 and radial wheels 16. The wheels are mounted on shafts 19 and 18 respectively. They are fixed to the turret bearing support structure 17 transferring the turret loads to a turret structure including a turret barrel 12.

Figure 8:
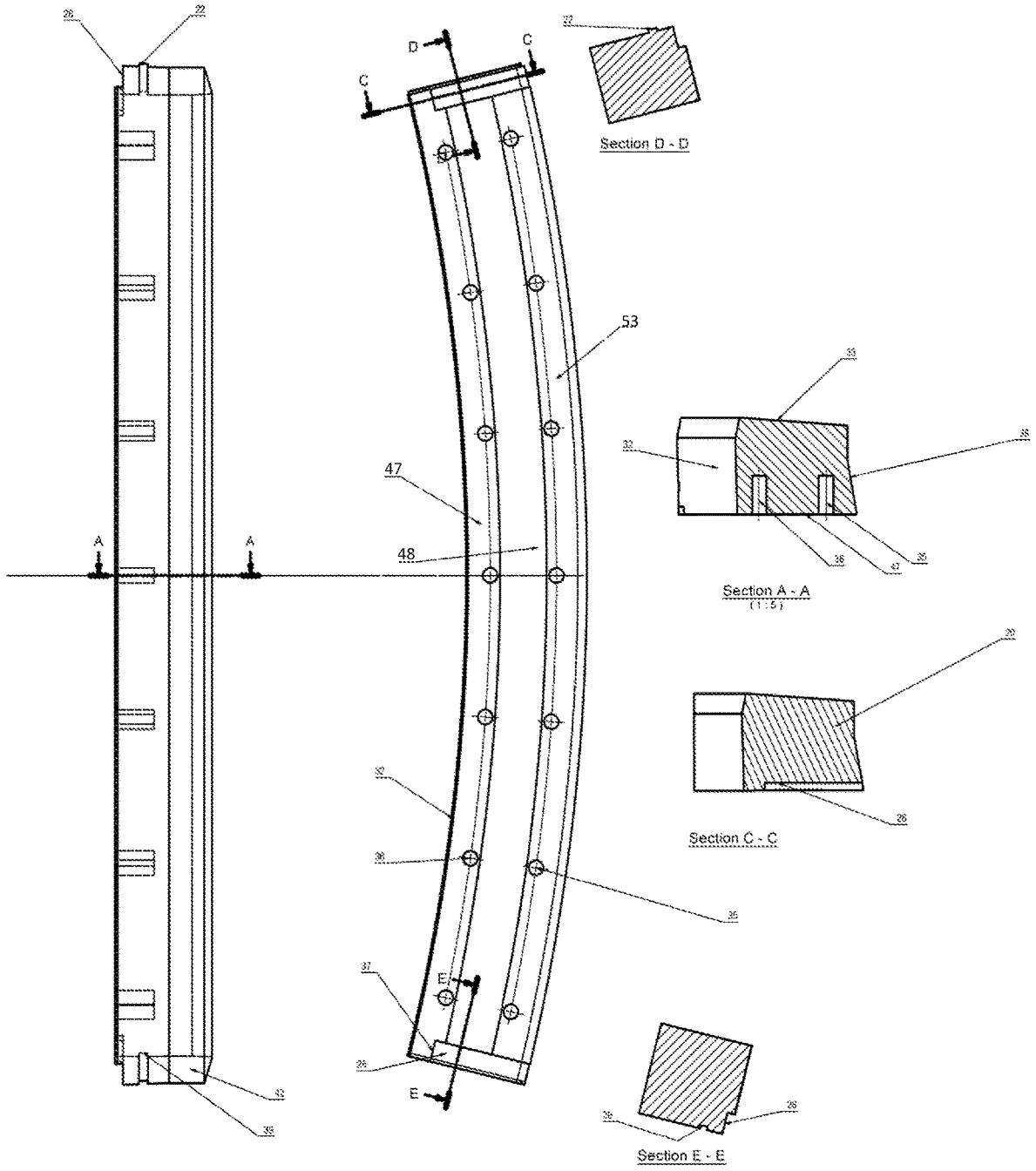
FIG. 8 shows a rail segment from the inner and bottom side together with four sections A-A, C-C, D-D, and E-E.

The mooring lines are commonly fixed to the lower portion of the turret barrel as illustrated in FIGS. 1 and 3. The axial wheels are running on an upward facing raceway 33 (FIG. 8) and the radial wheels on an inward facing raceway 32 (FIG. 8). The inward top edge of the rail has beneficially a sloping and curved section in order to match the wheel flanges. The rail 14 in this bearing system features both raceways. In this particular turret bearing system there is no bearing raceway handling upward directed loads since those loads are handled by other means. The principles for this rail system may however also beneficially be used for bearing systems with a separate raceway for partaking in upward directed loads.

Figure 4:
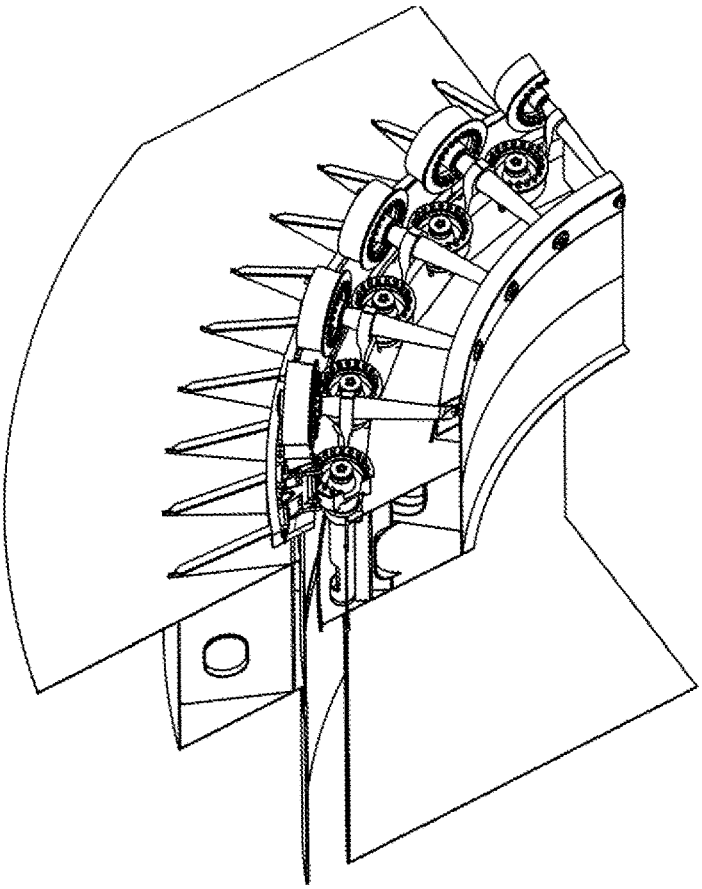
FIG. 4 shows a segment of the turret wheel bearing with a clear view of the wheels.

FIG. 4 shows a segment of the bearing system with the turret bearing support structure 7 to the left side and the wheel bearing support structure to the right. The bearing system is comprised of a number of axial 15 and radial 16 wheels for transfer of the mooring and riser loads to the vessel, while featuring easy rotation for the weather vaning of the vessel.

Figure 5:
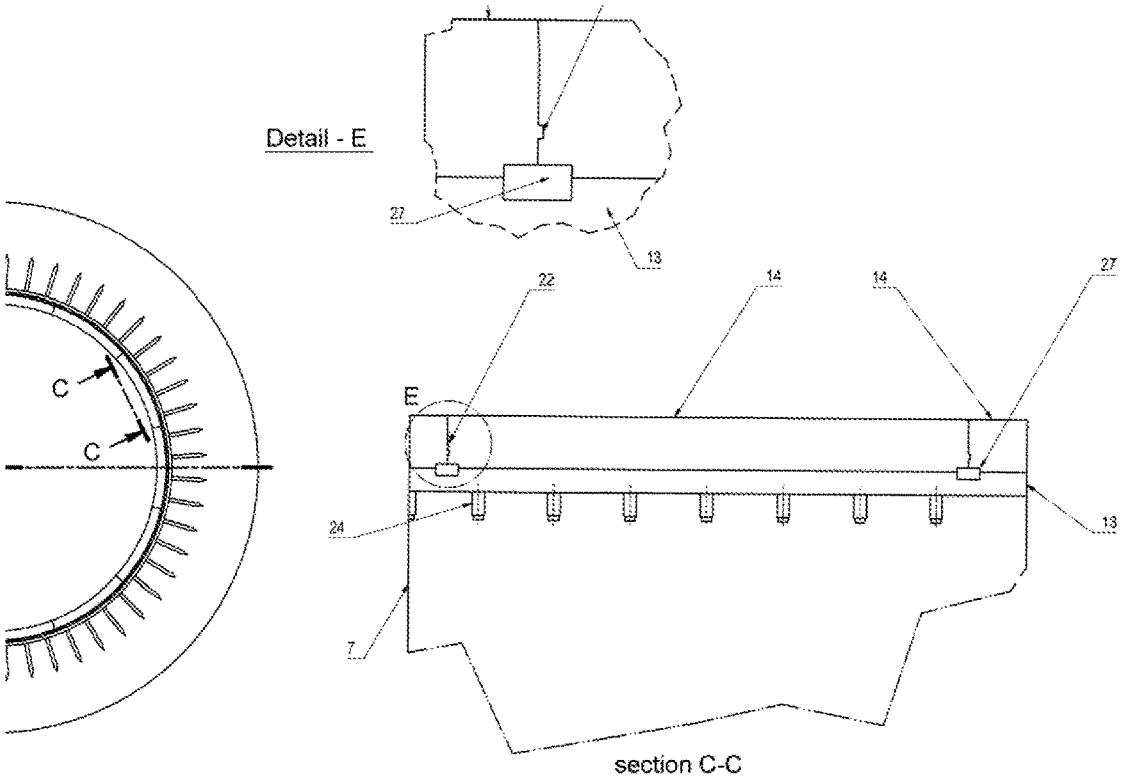
FIG. 5 shows a turret rail with two details.

Half of the turret rail in FIG. 5 is shown on the left hand side, and a close up of a side view of one segment is shown in section C-C on the right hand side, and with a further detail of the joint between two adjacent rail segments on the top right portion of FIG. 5. The rail segments 20 are clamped to the rail support ring 13 by a number of rail bolts 24 beneficially extended and using short sleeves for obtaining a high L/d for the bolts for reduced likelihood for loss of bolt pretension during operations. Each rail segment comprises a rectangular retainer groove 26 positioned at the lower corner of the end face 42 of each rail segment 20, and the support ring 13 comprises retainer grooves 28 corresponding to the two retainer grooves 26 in adjacent rail segments 20, thus forming a hole into which a retainer rod 27 fits as shown in detail E in FIG. 5. The rail has an inner and outer ring of threaded holes 35, 36 as illustrated in FIG. 8.

The distance between the individual bolts are importantly sufficient to keep contact all the way also between the wheel contact points. This is because rails on elastic support tend to react upwards some distance from the point of loading. There is a tongue 22 and groove 39 connection between each adjacent rail segment 20. This is to ensure a smooth upward raceway surface 33 of the rail.

Figure 6:
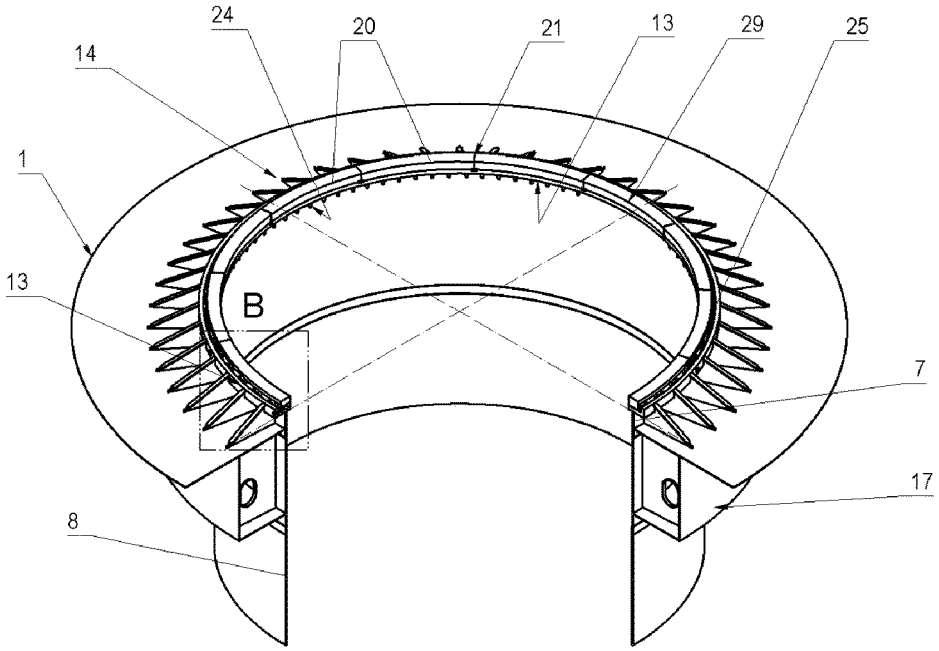
FIG. 6 shows a rail system with a support structure.

FIG. 6 shows an isometric view of the rail system with a rail support ring 13 and turret bearing support structure 7. The rail is preferably aligned with the rail support structure 7 and the turret well 8 underneath. The horizontal turret loads are handled by the vessel 1 deck structure.

Figure 7:
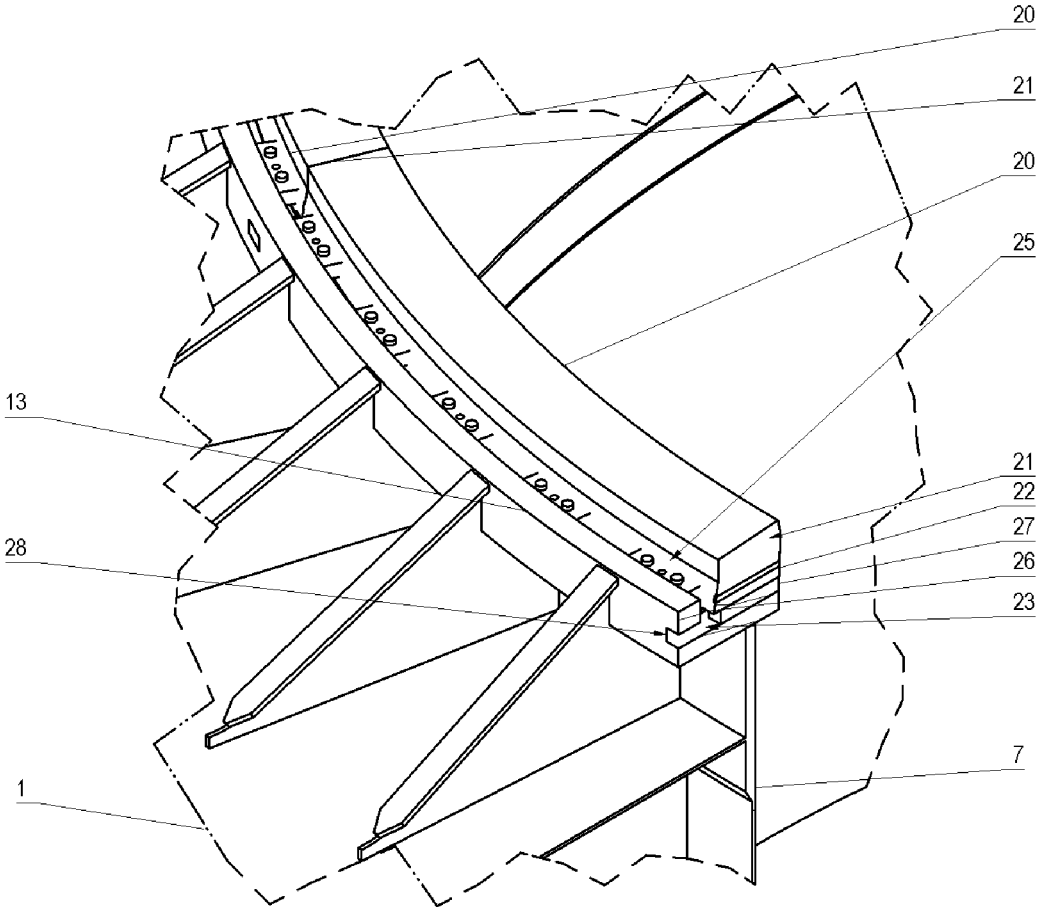
FIG. 7 shows a detail of the rail system with wedge assemblies.

FIG. 7 is a close up, detail of the frame B in FIG. 6, and illustrates a rail segment 20 as mounted onto the rail support ring 13. There are a number of wedge assemblies 25 for each of the rail segments located outside between the rail segment and the support ring 13. A retainer rod 27 is located in between the rail segments, and are installable and retrievable through openings 28 in the outer portion of the support ring. Each wedge 43 is fixed to the support ring by two bolts. The wedges are described in more detail in FIG. 9 through 12.

One retainer rod 27 is present in each rail joint 21 between all the rail segments. The function of these are further explained below and can be seen in FIGS. 5 and 13.

FIG. 8 shows the rail segment 20 in more detail. The groove 26 for the retainer rods is preferably rectangular shaped, and terminated a little outward from the inward raceway 32, allowing the inward facing raceway for the radial wheels 16 to be continuous, and is also an inward limitation for the position of the retainer rods 27.

The outward facing sloped wedge mating face 38 is declining at about 10 degrees from the vertical in order to provide a suitable locking effect from wedges 43 when they are pressed downwards, and to provide a good wedge effect when it is driven down, and sufficiently sloped in order to obtain the intended inward, radial displacement of the rail for the practical achievable vertical wedge displacement.

Figure 9:
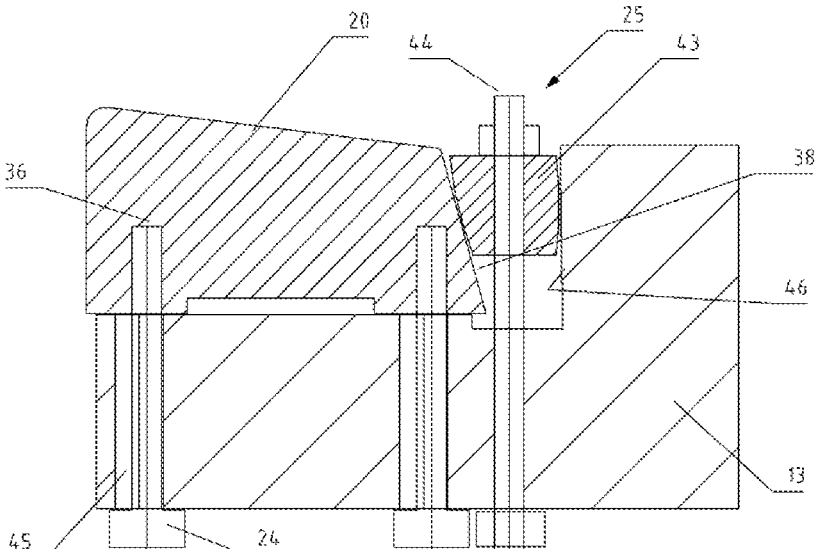
FIG. 9 shows a cross section of the rail onto the rail support ring before tightening.
Figure 10:
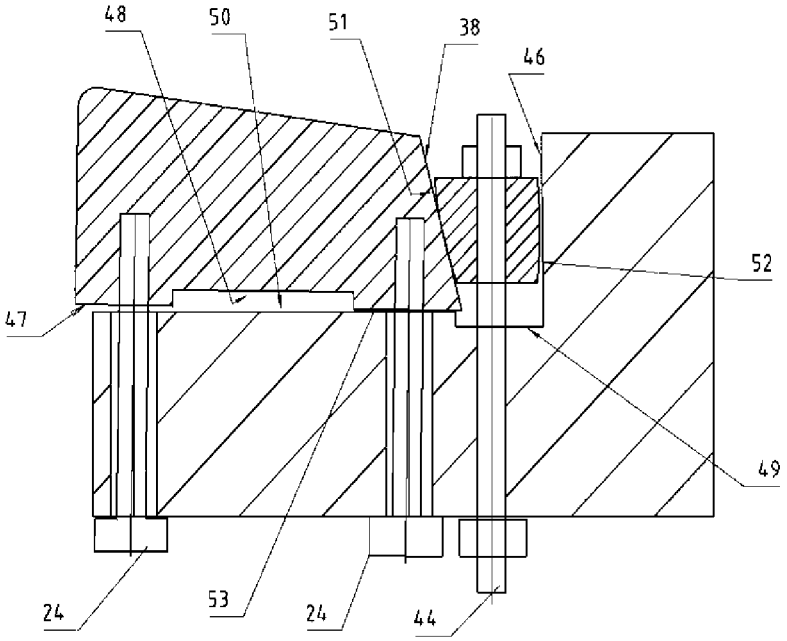
FIG. 10 shows the rail and rail support ring during the process of tightening.

The wedge 43 is shaped with a geometry complementary with its mating surfaces on adjacent rail segments 20 and the rail support ring 13 respectively, except that they also have a convexly curved cross section as is illustrated in FIG. 9 through 12. The benefit of this feature is obvious from FIG. 10 illustrating one intermediate step during the pre-installation operation where the rail segments are tilting a bit in response to the preloading. Significant extra pressure between the wedge and its mating surfaces on both sides might arise causing scuffing tendencies in the mating surface when the wedge is displaced either downwards or upwards if the wedge was made with equally sloped plane faces as the mating faces during unloaded condition without regard to deformations during installation sequence. With references to the deformation principles in FIG. 12, the most damage prone areas are top edge between of the wedge and the rail mating face 38 on one side, and the wedge bottom edge toward the inward mating face 46 on the flip side of the wedge. The wedge itself may also have a tendency to tilt a bit during the preloading due to skew resistance and eccentric bolt load vs. resistance. These curved surfaces offer also some room for tolerances and deformations.

FIG. 9 shows a cross section of the rail onto the support ring 13 with a wedge, also it shows the rail in a position prior to pushing the wedges 43 down by tensioning of the wedge bolts 44.

FIG. 10 is showing one of several intermediate steps during a pretension sequence of the rail system. The pre-installation sequence is comprised of a number of steps whereby the wedges and the rail bolts are tensioned up.

Initially, all the rail segments 20 are placed onto the support ring 13 outer portion with the outward face 38 of the rail segments close to the inward wedge mating face 46 of the support ring. With the rail segments in this position, there will be sufficient clearance between a tongue 22 and end face 42 of one rail segment and the end face 42 and groove of the adjacent rail segment to allow for a next rail segment to be lowered into position.

The rail segments are easily slid inward by hand or temporary means such as wooden wedges until the entire gap between the rail segments close up, with the tongues 22 entering the grooves 23 and finally that the rail segment end faces 42 touches each other.

Wedges 43 with wedge bolts 44 are inserted between the inward face 46 of the support ring 13 and the outward sloped face 38 of the rail segments 20. The wedges 43 may be used in the final stages of bringing the individual rail segments to close contact. Initially the rail bolts 24 are mounted and hand tightened only and cautiously tensioned up during the pre-tension sequence as the wedge is pressed downward.

The position of the rail segments are now checked for being in correct position with regard to the circularity of the rail system. The rail system is now ready for the tension up operation which is comprised of repeated wedge bolt 44 tensioning, rail bolt 24 tensioning and tension release until the rail segments have been properly compressed; i.e. that the wedge bolts have attained the intended downward displacement.

Each tensioning step is comprised of the following sub steps: the wedge is displaced a few mm's downward by tensioning the wedge bolts 44; thereby, the rail is compressed and moves a little inward (the rail diameter shrinks according to increase of tangential compression stresses in the rail). The tension in the inward rail bolts 24 are then released one by one in order to relieve the bending effects which have arisen in the rail bolts 24 in response to the inward shift in radial position of the rail segments relative to the rail support ring 13.

When the secondary bending effects have been relieved from all the rail bolts 24 they are tensioned up a bit so that the gap between the inward portion of the rail segment 20 and the rail support ring 13, as illustrated in FIG. 10, is closing down, sufficient to avoid the rail segment to tilt too much during the next stage downward displacement of the wedge, and easy enough to ensure the rail segment is sliding inward corresponding to the downward displacement of the wedge.

The wedges 43 have beneficially two convexly curved faces mating with a surface 51 and a surface 52 on the rail and support ring respectively to avoid edge pressure in the contact zone between the wedge 43 and the mating surfaces as pressure builds up during the tensioning sequence. The rail will during the tensioning sequence tilt around the outward edge of the outer, downward facing surface 53 of the rail as illustrated in FIG. 10, with the inner downward facing rail surface 47 having a substantial clearance in the range of 2-3 mm. There is also a recessed portion 49 of the support ring 13 for ensuring that the outward edge of the rail is free to move outward during retrieval of a rail segment. The rail segments is prevented from displacing vertically relative to each other because of the tongue 22 and groove 39 connection in the rail joints 21.

The rail segments tends to tilt upwards as illustrated in FIG. 10 more and more as the wedges 43 are pressed downward as the wedge bolts 44 are tensioned. The outward portion of the rail segments are pressed downwards and inwards as the wedges moves downward. To counteract the tilting effect, the rail bolts 24 on the inner pitch circle are tensioned up gradually to limit the tilting effect, although not more than what permits the rail segments to move inwards.

Figure 11:
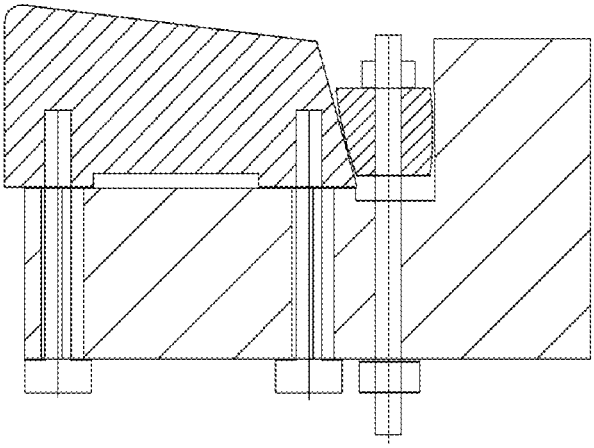
FIG. 11 shows a tightened rail system.
Figure 12:
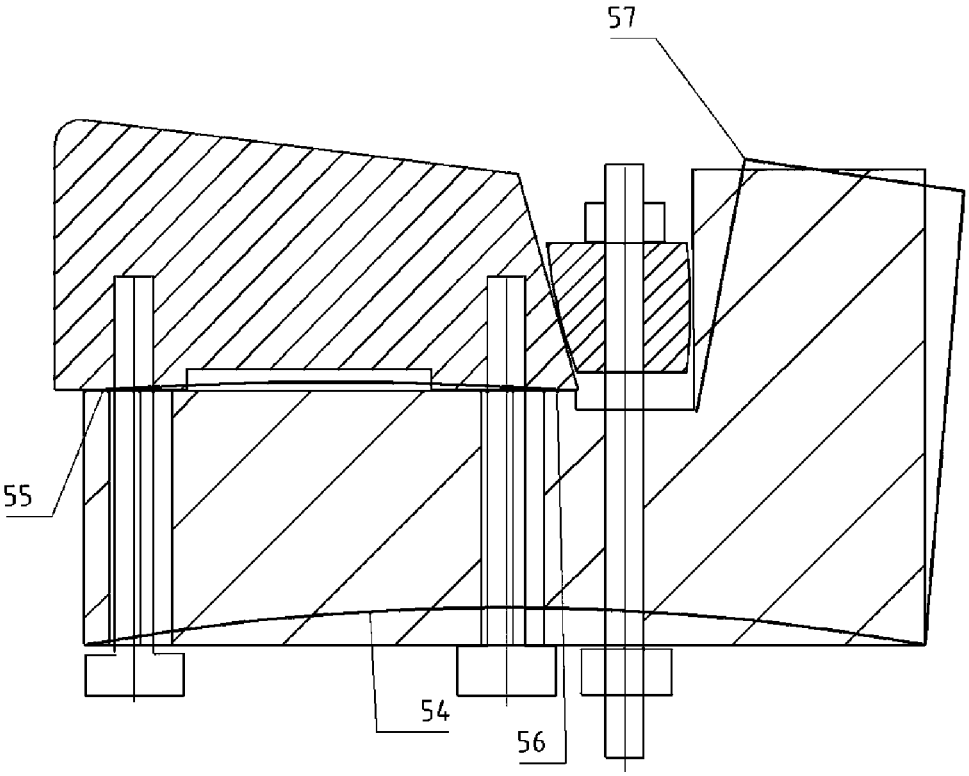
FIG. 12 shows how the rail support ring arches during tightening (exaggerated).

A significant tangential compressive force/compression stresses builds up in the rail segments, and the diameter of the rail system decreases. Simultaneously, the rail support ring underneath deforms outward. The line 54 in FIG. 12 illustrates an exaggerated upward bending of the support ring. Therefore, bolt holes 45 in the support ring 13 are elongated in the radial direction of the turret to accommodate the rail bolts when tensioning the rail. They are beneficially also positioned with a slightly larger ring (pitch circle) than the ring for the threaded bolt holes 35, 36 in the rail segments (FIG. 7*b*). FIG. 11 shows the wedge tightened and both the inner and outer ring of rail bolts 24 tightened. The bolts are now position towards the inner edge of the bolt holes 45

One effect of the radial displacements, the rail segments inward, and the rail support structure outward, is that the moderately tensioned bolts in the inner ring (pitch circle) is attaining bending stresses since the bolt heads are moving along with the displacing mating surfaces. The installation sequence includes therefore also steps whereby every second of the inner rail bolts 24 are relieved for tension at regular intervals in order to let the secondary bending stress effects in the bolts to be nullified. The bolts in the outer ring (pitch circle) remains only hand tightened throughout the tension sequence since the wedges 43 alone are sufficient to press the rail down onto the support ring 13.

The rail segments are advantageously equipped with a recessed portion 48 on the lower face leaving two defined plane surfaces 47 (inner) and 53 (outer). This is to ensure good and stable (wide) support for the rail segments, and to achieve a good and stiff contact by means of the rail bolts. (important to avoid loosening of the rail bolts).

FIG. 12 illustrates the said effects: the support ring develops an upward arched shaped profile, exaggerated in the illustration by the line 54, as the wedges are pressed down as the wedge is squeezing the rail mating face outward represented by the line 57 in FIG. 12. A rail mating surface 50 on the support ring 13 develops a correspondingly upward arched curve as illustrated. It is then seen that the recessed portion of the rail segment ensures that the two downward facing rail surfaces 47 and 53 come into defined contact with the support ring at a good distance apart in an inner region 55 (left hand side toward the turret center) and an outer region 56.

It is an important feature here that the contact between the rail and the support ring is located at defined areas to stabilize the rail segment onto the radial support ring to avoid it from pivoting back and forth when the heavily loaded wheels are passing by.

a very important aspect obtained by the contact regions (55, 56) close to the rail bolts is to maintain resilience of the rail bolts (with reference to force deflection diagrams according to standard bolt theory). This is important to avoid bolts getting loose over time.

Figure 13:
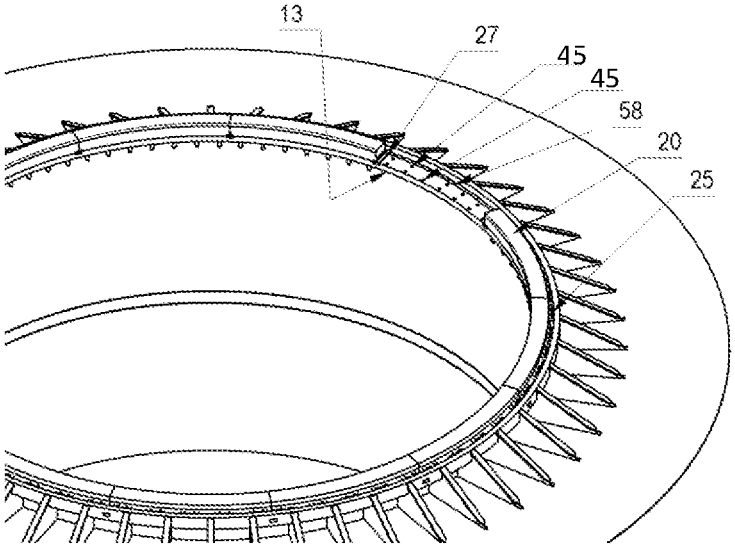
FIG. 13 shows the rail system with one segment removed.

FIG. 13 illustrates a rail system with one rail segment removed. The remaining rail segments remain pre-tensioned by the wedges which are still in a pre-tensioned state in combination with the retainer rods 27 preventing the adjacent rail segments to be pressed toward the empty space from the removed rail segment. The rail support ring 13 comprises an inner and outer ring of radially elongated bolt holes 45 corresponding to the threaded bolt holes 35, 36 in the rail segments 20. Although the remaining rail bolts still have a high pretension, a few of the bolts closest to the rail segment to be retrieved may need relaxation to avoid interaction effects in tongue and groove connection. In so doing, the corresponding rail segments tend to tilt upward with a small clearance to the support ring on the inward diameter of the rail. The support ring 13 is therefore advantageously made with a recessed portion 49 to give way for the rail segment moving outward even at a slight tilting angle.

The remaining part of the rail system will then suitably function as static support for the turret bearing system except for the wheels located just in way of the rail segment 20 to be replaced.

The rail is typically divided into 10-15 rail segments. Ref. FIG. 10, The space between the outward face 38 of the rail segment to the inward face 46 of the rail support structure, the space accommodating the wedges 43, are sufficient for the rail segment to be slid outward far enough for the tongues of the rail segments to go clear of the corresponding grooves, thus facilitating the lifting of the rail segment.

An advantage using the wedge system is that high preloading of the rail may be achieved even with moderate bolt tension, it is easy to control the pretension accurately. The pretension is performed by displacing the wedge a predetermined distance, in the order of 20 to 30 mm. The rail then displaces inwardly in accordance with the wedge angle, and the relative cross sectional area of the rail versus the supporting ring with adjacent rail support structure reduces. Hence, a rather accurate pretension level in the rail may be predicted. The bolts in the wedge system is advantageously largely not subjected to alternating stresses caused by the high alternating turret bearing loads; since the wedge system is advantageously locked in position by the combination of wedge slopes and friction resistance between the wedge and its mating surfaces.

For a rail system comprising 11 rail segments, the contact angle between the end surfaces 42 of a rail segment is 360/11=27.7 degrees, or 13.85 degrees relative to the symmetry line for the segment. The sine effect of such an angle is 0.24; larger than the friction angle for smooth surfaces. The rail segment will hence be pressed initially by the inherent outward force effect from the tangential pressure in the rail system. The force component from the adjacent rail segments are sufficient to squeeze the rail segment to be replaced just by the preloading effect in the rail system. However, the adjacent rail segments will only be permitted to expand but parts of a mm because the retainer rods 27 (FIG. 12) will limit the expansion of the rail system and ensure that the rail system remains in position. The rail joints are advantageously treated to ensure a low friction coefficient to ease such retrieval operations: One of each of each pair of the rail segment end surfaces 42 are applied with a Teflon-like coating to ensure low friction coefficient also after some time in operation.

The number of wedges must be high enough to ensure a distributed pressure on the ring 13 through the face 46, to secure a constant curvature of the rail segments in combination with providing high pretension force even with moderate loaded wedge bolts 44. Typically, approximately 50-75 wedges around the circle of the rail should be sufficient for a typical size turret in the industry. Regarding the pressure outward on the ring 13 it should be noted that secondary bending stresses arises in the upper portion of the ring 13 as illustrated in FIG. 12. The deformation will be more even along the periphery of the ring with small distance between the wedges.

Figure 14:
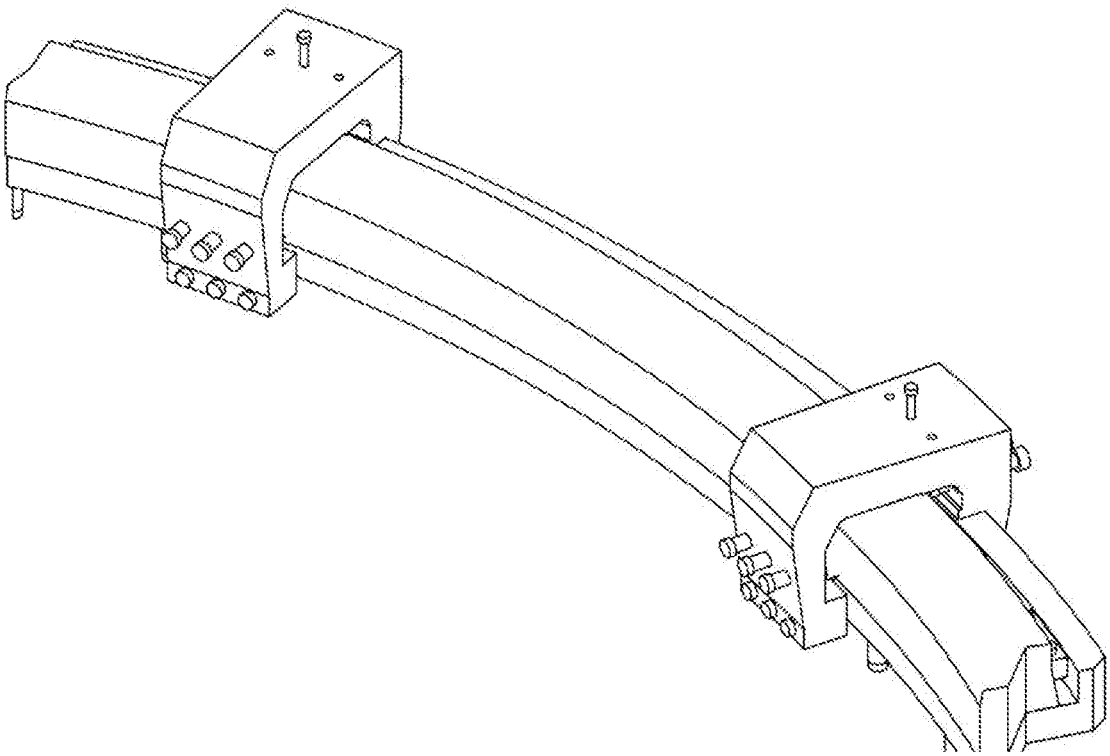
FIG. 14 shows an alignment tool mounted at each end of a segment.
Figure 15A:
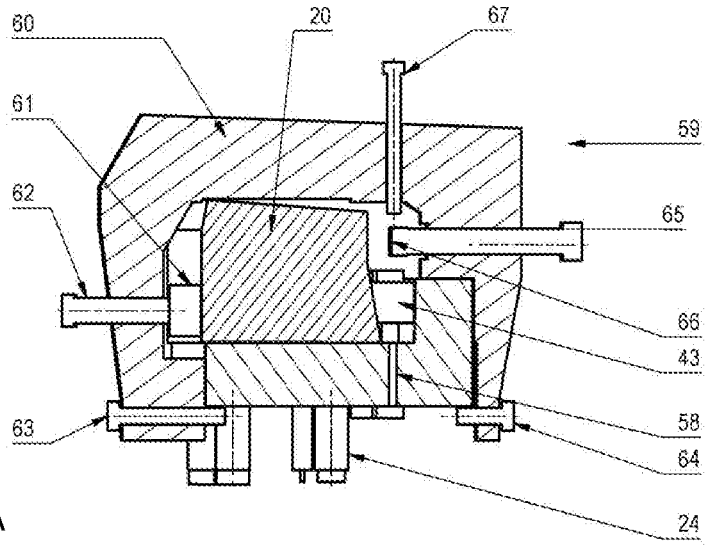
FIG. 15 shows a cross section of an alignment tool.

A tool 59 as illustrated in FIG. 14 and FIGS. 15*a* and *b* may be used for getting the rail segment loose in case the friction in the rail joints 21 exceed the said inherent outward squeezing force. The tool will also be useful in connection with the re-installation of the new rail segment.

The tool comprises a U-frame 60 with one, but preferably three horizontally positioned bolts 62, 65 on each side for pressing the rail segment outward or inward. Rotationally detached discs 61, 66 with enlarged diameter are fixed to the bolt ends to ensure a moderate pressure onto the rail segment surfaces. Furthermore, the rotary motion of the bolts is taken by the discs to ensure a static connection surface between the discs 61, 66 and the rail. The disc 61 is a push out disc to push the segment out and the disc 66 is a push in disc to push the segment in. Correspondingly the bolt 62 is a push-out bolt and the bolt 65 is a push-in bolt.

Referring to FIG. 5B, the frame of the tool is adapted to be arranged over the rail 14 and support ring 13 such that at least one push-in bolts 65 and two push-out bolts 62 clamps the rail segment adjacent to the rail segment to be removed and at least two push-in bolt 65 and one push-out bolt 62 clamps the rail segment to be removed. This position is beneficial in the initial and final stages of the operation for adjusting the relative position of the adjacent rail segments.

Correspondingly, the tool may be emplaced on each of the two adjacent rail segments when the new rail segment is inserted. Then the tool will be beneficial for ensuring that the intact, fixed part of the rail system does not come out of position by the inward force exerted in the rail joint surfaces as the new rail segment is inserted and pressed inward by use of the wedges.

The tool also includes some secondary means such as an inner and outer restrainer bolt 63 and 64 to keep the tool in position, to prevent it from flipping upwards. Also a bolt 67 for initial insertion of wedges can be positioned over the wedge region pointing downward and is meant for pushing the wedge 43 downward far enough for the wedge bolt 44 to come through the bolt holes 58.

The tool may be made in a simpler version with only one set of bolts 62,65. The bolt 62 will then in the same way as for the tool described above be used for pushing the rail segment to be replaced by locating the tool in way of the same segment toward the joint. The wedges 43 are then used for pushing the new rail segment in to position while the tool is re-located to the other side of the rail joint, in way of the adjacent rail segment, one tool at both rail joints, to restrain the adjacent rail segment from being pushed too far inward; from the friction effects arising from the new rail segment sliding inward along the rail joint face and a smooth alignment between the new rail segment and the adjacent ones are achieved.

A bolt 69 is arranged in the wedge for pushing the wedge upward during removal if friction should hold the wedge in place when the wedge bolts are removed. It may be an advantage to include 2 bolts 69 for better control of the jacking up of the wedge bolts.

A method for mounting the rail system according to the invention will comprise the steps of:

a) Mounting the L-shaped rail support ring 13 on to the turret bearing support structure 7. This could be done by bolting or welding b) Placing the rail segments 20 on the outer part of the rail support ring 13 and sliding them inward until the tongues 22 mates with the grooves 39.

c) Inserting rail bolts 24 and tighten them to a first low threshold.

d) Mounting wedges 43 with bolts and tighten the wedge bolts to a first low threshold.

e) Inserting the retainer rods 27 if applicable. (This could also be done prior to the lay down of the rail segments).

f) Tightening the ring of wedge bolts until the inner part of the rail rises above the support ring 13 to a predetermined level.

g) Tightening the inner ring of rail bolts until the inner part of the rail is close to the support ring.

h) Repeating step f and g until desired compression is achieved, and occasionally loosening parts of the inner ring of rail bolts 24 at different times to relieve tension and enable them to move inward along with the rail segments.

i) Tightening both the inner and the outer ring of rail bolts 24 to full pretension. The outer ring of bolts is normally left untouched during the entire operation.

A corresponding method for replacing a rail segment when the turret is under load comprises the steps of:

a) Locking the rotating movement of the turret, b) Dismounting the wheels resting on the rail segment to be removed, c) Releasing the tension in the wedge bolts d) pushing the wedges upward a small portion/a few mm (of the complete wedge stroke)

e) relieving the main portion of the tension in the rail bolts of the rail segment until loss of contact pressure between the rail segment and the support ring at the inward periphery of the rail, and the tension in the bolts in the 2 adjacent rail segments relieved as well, gradually less far away f) push the wedges further upward, relief bolt tension further in steps until tangential compression in the rail segment is relieved.

g) Remove the wedges holding the rail segment to be removed, h) unbolt the rail bolts in way of the loose rail segment i) Pushing the rail segment outward until grooves and tongues are free, j) Replace rail segment, k) Executing step b-i according to the method for mounting the rail segments, l) Mounting the removed wheels, m) Unlocking the rotating movement of the turret.

Figure 15B:
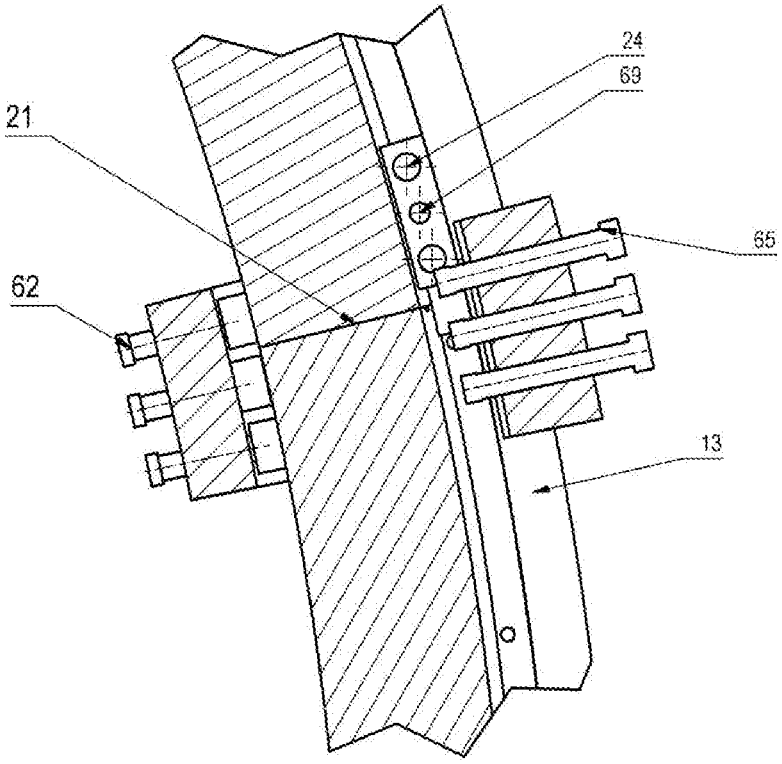

The bolts 62 and 65 may be used for radial alignment of the replaced rail segment with the adjacent rail segments in as shown in FIG. 14 and FIG. 15*b* by e.g. pushing inwardly onto the replaced rail segment by the two bolts 65 along with the pressure from the wedges, and using the bolts 62 for restraining the adjacent rail segment from being pushed inwardly as the replaced rail segment is being pushed into position.

In one embodiment, the rail system may also comprise dual rails suitable for systems where a second rail is arranged at a larger diameter. Further embodiments may comprise separate rail systems for the axial and for the radial wheel bearing systems.

Definitions

1 vessel
2 mooring line
3 sea floor
4 water line
5 turret
6 turret bearing
7 turret bearing support structure
8 turret well in vessel
9 rotatable fluid/gas/power connection (swivel)
10 riser termination in turret
11 submarine riser
12 turret barrel
13 rail support ring
14 rail
15 axial wheel (turret bearing)
16 radial wheel (turret bearing)
17 bearing support structure
18 shaft for radial wheel
19 shaft for axial wheel
20 rail segment
21 rail joint
22 tongue in end of rail segment to fit mating groove 39 in adjacent rail segment
23 groove in the rail support ring to fit retainer rod 27 (FIG. 7)
24 rail bolts (for clamping the rail segments to the rail support ring 13)
25 wedge assembly (comprising wedge and bolts)
26 retainer groove in the rail segment for retainer rod 27
27 retainer rod
28 opening in rail support ring 13 for retrieval of the retainer rod 27
32 inward facing raceway for radial wheels
33 upward facing raceway for axial wheels
34 rail system comprising rail segments, wedges with bolts, rail bolts and retainers.
35 threaded bolt holes in rail segment for the outer ring of rail bolts
36 threaded bolt holes in rail segment for the for inner ring of rail bolts
37 Inward termination for the groove 26
38 Sloped outward mating wedge face on rail segment
39 Groove in rail segment to fit tongue 22 in mating rail segment
42 End face of rail segment
43 Wedge
44 Wedge bolt
45 Hole in support ring 13 for rail bolts 24
46 Wedge mating face on support ring 13
47 Inner, downward facing rail surface of rail segment, for contact to the upward facing surface of the rail support ring 13
48 Recessed part of rail segment between the inner and outer protruding underside faces of the rail segment
49 Recessed portion in support ring 13
50 Rail mating face on support ring 13
51 Wedge mating face on rail
52 Wedge mating face on rail support ring
53 Outer, downward facing rail surface of rail segment, for contact to the upward facing surface of the rail support ring 13
54 Line representing deformation profile of the supporting ring 13 (FIG. 12)
55 Inner contact region between rail segment and rail support ring
56 Outer contact region between rail segment and rail support ring
57 Deformed shape of the rail support ring structure in way of the wedges
58 Hole for wedge bolt in support ring
59 Replacement tool assembly
60 Replacement tool frame
61 rail push-out disc
62 rail push-out bolt
63 outer restrainer bolt
64 inner restrainer bolt
65 rail push-in bolt
66 rail push-in disc
67 bolt for temporary and initial wedge insert operation
69 retrieval bolt in wedge for retrieval of wedge itself

The invention claimed is:

1. A rail system for a large turret bearing comprising:
a turret bearing support structure;
a rail support ring provided with a L-shaped cross section comprising an inward directed wedge mating face, at least two rings of radially elongated segment bolt holes, and an outermost ring of wedge bolt holes;
a plurality of rail segments together forming a complete circle with an outer radius slightly smaller than the radius of the wedge mating face of the rail support ring, each segment comprising:
a sloped outer wedge mating surface;
a downward facing contact surface with threaded bolt holes corresponding to the bolt holes in the rail support ring;
an upper largely horizontal surface; and
an inner largely vertical surface;
trapeze shaped wedges, each trapeze shaped wedge having at least one bolt hole and corresponding bolt (s), adapted to be tightened down between the wedge mating face of the support ring and the sloped outer wedge mating surface of the segments; and
rail bolts for fastening the rail segments.

2. The rail system according to claim 1, wherein the rail segments comprise a recessed downward facing portion between an inner and outer downward facing contact surface, comprising inner and outer threaded bolt holes, and the rail support ring comprises an inner and outer ring of radially elongated bolt holes corresponding to the treaded bolt holes in the rail segments.

3. The rail system according to claim 1, wherein the rail segments comprise a retainer groove positioned at the lower corner at the end face of each rail segment, and the support ring comprises retainer grooves corresponding to two retainer grooves in adjacent rail segments, thus forming a hole into which a retainer rod fits.

4. The rail system according to claim 1, wherein a tongue and a mating groove is fitted in respective ends of each rail segment.

5. The rail system according to claim 1, wherein the rail bolts are extended in length and a sleeve is fitted on each bolt.

6. The rail system according to claim 1, wherein the two mating surfaces of a wedge have a slightly convex shape.

7. The rail system according to claim 1, wherein a wedge has at least one vertical retrieval bolts.

8. The rail system according to claim 1, wherein the outer portion of the rail support ring has a recessed area, outside of the rail segments to give way for a rail segment to be retrieved while the rest of the rail system remains in place.

9. The rail system according to claim 1, comprising a tool for removal and insertion of a rail segment, the tool comprising:
a U-shaped tool frame;
at least one inward directed push-in bolt;
at least one outward directed push-out bolt;
at least one inner restrainer bolt; and
at least one outer restrainer bolt;
wherein the frame is adapted to be arranged over the rail and support ring such that at least one push-in bolt(s) and at least one push-out bolt(s) clamps the rail segment to be removed.

10. The rail system according to claim 8, wherein the tool has at least two inward directed push-in bolts, and at least two outward directed push-out bolts, wherein the frame is adapted to be arranged over the rail and support ring such that at least one push-in bolts and one push-out bolts clamps the rail segment adjacent to the rail segment to be removed and at least one push back bolt and one push-out bolt clamps the rail segment to be removed.

11. The rail system according to claim 8, wherein the push-in bolts and the push-out bolts of the tool for removal and insertion of a rail segment comprises a rotationally detached disc on ends thereof.

12. A method for mounting the rail system according to claim 1, comprising the steps of:
a) mounting the L-shaped rail support ring on to the turret bearing support structure;
b) placing the rail segments on the outer part of the rail support ring and sliding the rail segments inward until the tongues mate with the grooves;
c) inserting rail bolts and tightening the rail bolts to a first low threshold;
d) mounting wedges with bolts and tightening the wedge bolts to a first low threshold;
e) inserting the retainer rods, if applicable;
f) tightening the ring of wedge bolts until the inner part of the rail start to rise above the support ring;
g) tightening the inner ring of segment bolts until the inner part of the rail is close to the support ring;
h) repeating step f and g until desired tension is achieved, and occasionally loosening parts of the inner ring of rail bolts at different times to relieve tension; and
i) tightening the outer ring (s) of rail bolts.

13. A method for replacing a rail segment from the rail system according to claim 1, when the turret is under load comprising the steps of:
a) locking the rotating movement of the turret;
b) dismounting the wheels resting on the rail segment to be removed;
c) releasing the tension in the wedge bolts;
d) pushing the wedges upward a small portion/a few mm (of the complete wedge stroke);
e) relieving the main portion of the tension in the rail bolts of the rail segment until loss of contact pressure between the rail segment and the support ring at the inward periphery of the rail, and relieving the tension in the bolts in the adjacent rail segments as well, gradually to a lesser degree further away;
f) pushing the wedges further upward, to relieve bolt tension further in steps until tangential compression in the rail segment is relieved;
g) removing the wedges holding the rail segment to be removed;
h) unbolting the rail bolts in the loose rail segment;
i) pushing the rail segment outward until grooves and tongues are free;
j) replacing rail segment;
k) executing step b-i according to the method for mounting the rail segments;
l) mounting the removed wheels; and
m) unlocking the rotating movement of the turret.

14. The rail system according to claim 1, wherein a wedge has two vertical retrieval bolts.

15. The rail system according to claim 2, wherein the outer portion of the rail support ring has a recessed area, outside of the rail segments to give way for a rail segment to be retrieved while the rest of the rail system remains in place.

16. The rail system according to claim 3, wherein the outer portion of the rail support ring has a recessed area, outside of the rail segments to give way for a rail segment to be retrieved while the rest of the rail system remains in place.

17. The rail system according to claim 4, wherein the outer portion of the rail support ring has a recessed area, outside of the rail segments to give way for a rail segment to be retrieved while the rest of the rail system remains in place.

18. The rail system according to claim 5, wherein the outer portion of the rail support ring has a recessed area, outside of the rail segments to give way for a rail segment to be retrieved while the rest of the rail system remains in place.

19. The rail system according to claim 6, wherein the outer portion of the rail support ring has a recessed area, outside of the rail segments to give way for a rail segment to be retrieved while the rest of the rail system remains in place.

20. The rail system according to claim 7, wherein the outer portion of the rail support ring has a recessed area, outside of the rail segments to give way for a rail segment to be retrieved while the rest of the rail system remains in place.

* * * * *